United States Patent [19]

Suehiro

[11] 4,204,209

[45] May 20, 1980

[54] FLUORESCENT DISPLAY DEVICE COMPRISING A PAIR OF ANODE CONNECTION GROUPS

[75] Inventor: Jun-ichi Suehiro, Izumi, Japan

[73] Assignee: Nippon Electric Kagoshima, Ltd., Izumi, Japan

[21] Appl. No.: 958,554

[22] Filed: Nov. 7, 1978

[30] Foreign Application Priority Data

Nov. 7, 1977 [JP] Japan ..... 52-133865

[51] Int. Cl.[2] ..... H01J 17/48

[52] U.S. Cl. ..... 340/758; 315/169.1; 340/802

[58] Field of Search ..... 340/758, 802; 315/169.1

[56] References Cited

U.S. PATENT DOCUMENTS

| | | | |
|---|---|---|---|
| 3,588,571 | 6/1971 | Uemura et al. | 340/758 X |
| 3,761,766 | 9/1973 | Hatano et al. | 340/758 X |
| 3,875,442 | 4/1975 | Wasa et al. | 340/758 X |

*Primary Examiner*—David L. Trafton

*Attorney, Agent, or Firm*—Hopgood, Calimafde, Kalil, Blaustein & Lieberman

[57] ABSTRACT

It is a recent trend in a fluorescent display device comprising a plurality of anode units, each composed of segmented anodes arranged in a preselected configuration, that grids aligned in one-to-one correspondence to the anode units are rendered narrower in the direction of alignment. The device comprises a first and a second group of anode connections for every other one of the anode units and the remaining anode units, respectively, with each of all anode connections connected to a prescribed one of the segmented anodes of each anode unit. For making the device display at least one digit, a grid driver energizes all grids, preferably cyclically, a particular one at a time slot together with at least one nearest grid. An anode driver selectively energizes the anode connections of one of the two groups that includes the anode unit to which the particular grid is in one-to-one correspondence.

5 Claims, 6 Drawing Figures

FLUORESCENT DISPLAY DEVICE COMPRISING A PAIR OF ANODE CONNECTION GROUPS

BACKGROUND OF THE INVENTION

This invention relates to a fluorescent display device comprising a plurality of substantially aligned anode units, each composed of a predetermined number of segmented fluorescent anodes arranged in a preselected configuration. It should be noted here that fluorescence is not much different from phosphorescence and that the word "fluorescent" is used throughout the instant specification to cover the concept of luminescence emitted by a phosphorescent material with a shorter period.

In general, a display device of the type described comprises a plurality of grids opposite the respective anode units and a hot cathode over the grids to provide a visual display of at least one numeral together with or without a decimal point, at least one alphabet, or the like. Such a device will herein be called a multidigit fluorescent display device. When the device is driven in a time-division fashion, the grids are driven preferably cyclically. The segmented anodes are selectively driven in one of the anode units that is opposite the grid being energized. It is a tendency in a recent multidigit fluorescent display device that the grids are rendered narrow in the direction of alignment. In a device of the recent type, each digit does not luminesce with a uniform brightness. This results from an undesired influence of adjacent grid or grids as will later be described with reference to a few figures of the accompanying drawing.

SUMMARY OF THE INVENTION

It is therefore an object of this invention to provide a fluorescent display device comprising a plurality of substantially aligned anode units, each composed of segmented fluorescent anodes arranged in a preselected configuration, and a plurality of grids opposite the respective anode units, in which all segmented anodes are capable of substantially uniformly fluorescing even when the grids are narrow in the direction of alignment.

It is another object of this invention to provide a display device of the type described which is capable of being exempted from any adverse influence of adjacent grid or grids.

A fluorescent display tube to which this invention is applicable comprises two end grids, at least two intermediate grids between and in substantial alignment with the end grids, a plurality of anode units in one-to-one correspondence to all the grids, and a hot cathode over the anode units with all the grids interposed therebetween. Each of the anode units is composed of a predetermined number of segmented fluorescent anodes arranged in a preselected configuration. According to this invention, the display device comprises a first group of anode connections for predetermined ones of the anode units with each of the connections connected to a prescribed one of the segmented anodes of each of the predetermined anode units and a second group of anode connections for the remaining ones of the anode units with each of the second-group anode connections connected to a preselected one of the segmented anodes of each of the remaining anode units. The predetermined anode units are every other one of all the anode units.

DESCRIPTION OF THE PREFERRED EMBODIMENTS

Figure 1:
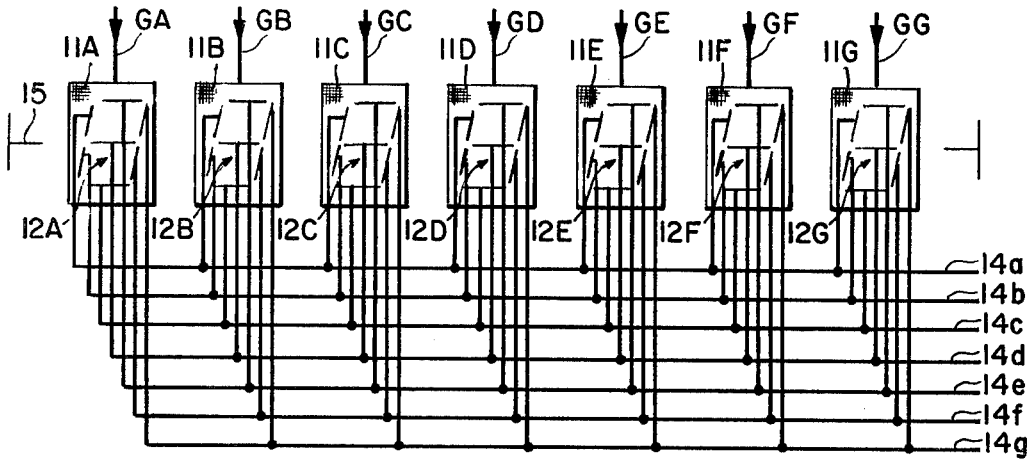
PRIOR ART FIG. 1
FIG. 1 shows a schematic diagram of a conventional multidigit fluorescent display device.

Referring to FIG. 1, a conventional display device will be described at first for a better understanding of this invention. The display device comprises first through seventh substantially aligned grids 11A, 11B, 11C, 11D, 11E, 11F, and 11G, each of which corresponds to the respective digits. The grids 11A–11G are arranged with a spacing therebetween and connected through grid leads or connections to a grid driver (not shown) for driving the grids 11A–11G in a time-division fashion. The grids 11A–11G are in one-to-one correspondence to anode units 12A, 12B, 12C, 12D, 12E, 12F, and 12G. In the example being illustrated, each of the anode units 12A–12G comprises seven segmented luminescent anodes arranged in a substantially figure-of-eight configuration in order to display a selected one of numerals 0 through 9. First through seventh anode conductors or connections **14*a*, 14*b*, 14*c*, 14*d*, 14*e*, 14*f*, and 14*g* are connected to the respective segmented luminescent anodes with each of the anode connections 14*a*–14*g* connected to a preselected one of the segmented anodes in each of the anode units 12A–12G. The respective anode connections 14*a*–14*g* are connected to an anode driver (not shown) for selectively driving the anode connections 14*a*–14*g* in synchronism with the drive of each of the grids 11A–11G. A hot cathode 15 is supported by supports over all the grids 11A–11G, as symbolized on both sides of this figure. The hot cathode 15 is continuously energized during use of the display device by a cathode driver (not shown) through a pair of cathode connections. Practically, the grids 11A–11G, anode units 12A–12G, and cathode 15** are enclosed with a vacuum envelope (not shown). The grid, anode, and cathode connections are for leading the respective electrodes outside the envelope.

Figure 2:
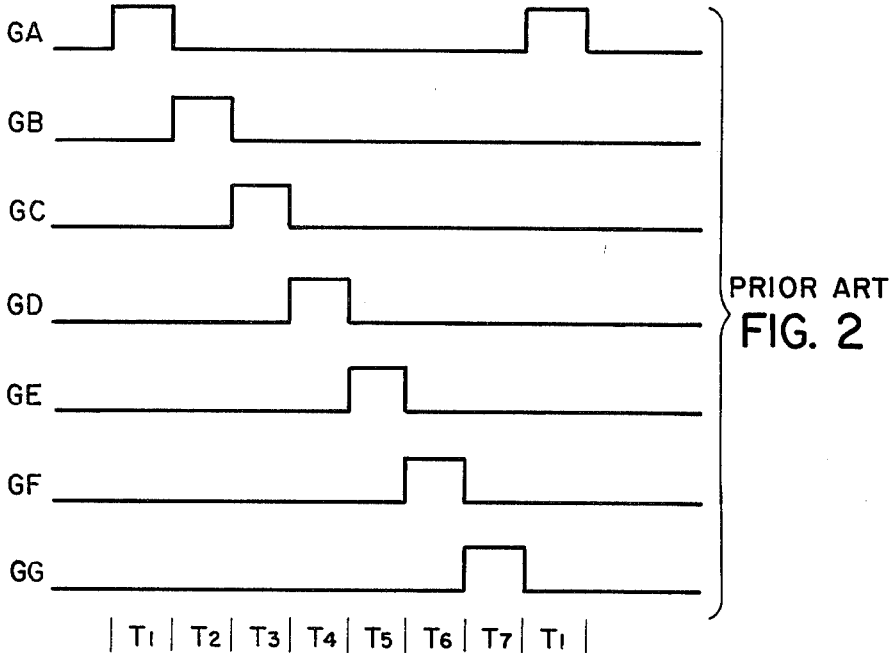
PRIOR ART FIG. 2
FIG. 2 is a time chart for describing operation of the display device illustrated in FIG. 1.

Referring to FIG. 2, the grid driver cyclically produces seven grid energizing pulses GA, GB, BC, GD, GE, GF, and GG in seven time slots $T_1$, $T_2$, $T_3$, $T_4$, $T_5$, $T_6$, and $T_7$, respectively, within a predetermined time interval, such as one-sixteenth of a second or shorter. The anode driver selectively energizes the anode connections **14*a*–14*g*** in synchronism with the time slots $T_1$–$T_7$. The selective energization in a particular one of the time slots may continue a plurality of the time intervals. On the other hand, the selective energization may be energization of none of the anode connections particularly in earlier time slot or slots, such as $T_1$, in at least one time interval. A display of a desired numeral is thereby given by the anode unit opposite the grid being energized.

It is to be mentioned here that thermal electrons emitted from the hot cathode 15 should reach with substantially uniform intensity to the selected one or ones of the segmented anodes of the anode unit opposing the energized grid. This uniform intensity is adversely affected in a recent multidigit fluorescent display device by a nearest grid that is next on one or each side of the energized grid and is not energized for the time being. The result is such that the brightness of a displayed digit becomes weak at the portion adjacent to the next digit or digits.

Figure 3:
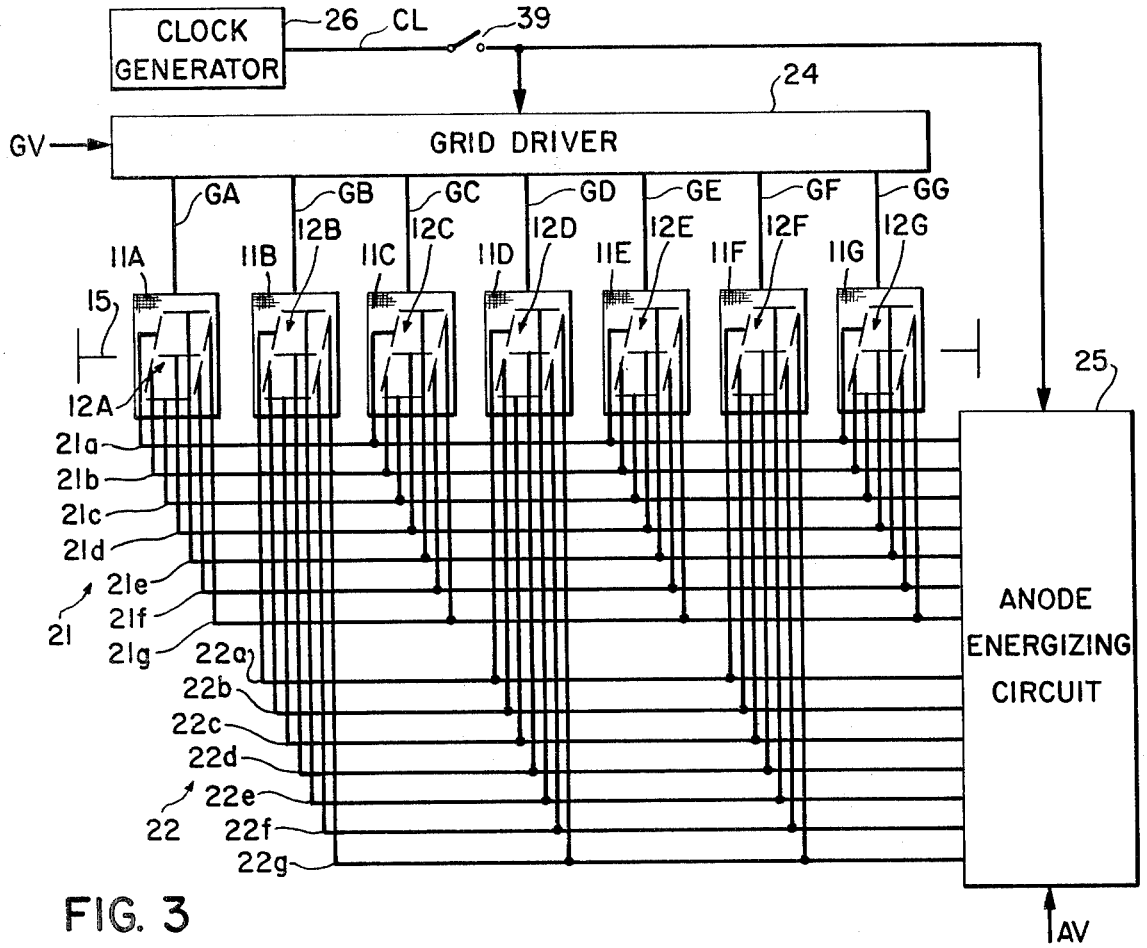
FIG. 3 shows a circuit diagram of a multidigit fluorescent display device according to an embodiment of this invention.

Referring now to FIG. 3, a display device according to an embodiment of this invention comprises first through seventh grids 11A–11G, first through seventh anode units 12A–12G, and a hot cathode 15 as illustrated with reference to FIG. 1. The display device further comprises a first group of anode connections 21 for the odd-numbered ones of the anode units, namely, first, third, fifth, and seventh ones 12A, 12C, 12E, and 12G, and a second group of anode connections 22 for the even-numbered anode units, namely, second, fourth, and sixth ones, 12B, 12D, and 12F. In other words, the first group 21 is for every other one of the anode units 12A–12G and the second group, for the remaining anode units. Each of anode connections *21a–21g* of the first group 21 is connected to a prescribed one of the segmented anodes of each of the odd-numbered anode units 12A, 12C, 12E, and 12G. Each of anode connections *22a–22g* of the second group 22 is connected to a preselected one of the segmented anodes of each of the even-numbered anode units 12B, 12D, and 12F.

Further referring to FIG. 3, the first and the seventh grids 11A and 11G will be called end grids for convenience of further description and the remaining grids 12B–12F, intermediate grids. For making the display device display at least one digit, the device further comprises a grid driver 24 connected to the grids 11A–11G through grid connections, respectively, and an anode energizing circuit 25 connected to the anode connections *21a–21g* and *22a–22g*. Supplied with an electrical voltage GV, the grid driver 24 energizes all grids 11A–11G, one at a time together with a nearest one of the intermediate grids 11B–11F and two nearest ones of all grids 11A–11G when the first-mentioned one grid is one of the two end grids 11A and 11G and one of the intermediate grids 11B–11F, respectively. The grid driver 24 should energize all grids 11A–11G within the time interval mentioned hereinabove. Each grid is thus energized at least at one time slot in the time interval. The first-mentioned one will be referred to as a particular grid in the following. Supplied with an electrical power AV, the anode energizing circuit 25 selectively energizes the anode connections of a specific one of the first and the second groups 21 and 22 without energizing the anode connections of the other of the groups 21 and 22 at a time. The specific one group should be composed of the anode connections connected to the segmented anodes of one of all the anode units 11A–11G that is in one-to-one correspondence to the grid the grid driver 24 is energizing as the particular grid. It is usual that the electrical voltage GV is nearly equal to the voltage of the electrical power AV. The time slots may be defined by a sequence of clock pusles CL generated by a clock generator 26 at a repetition frequency of the order of milliseconds.

Figure 4:
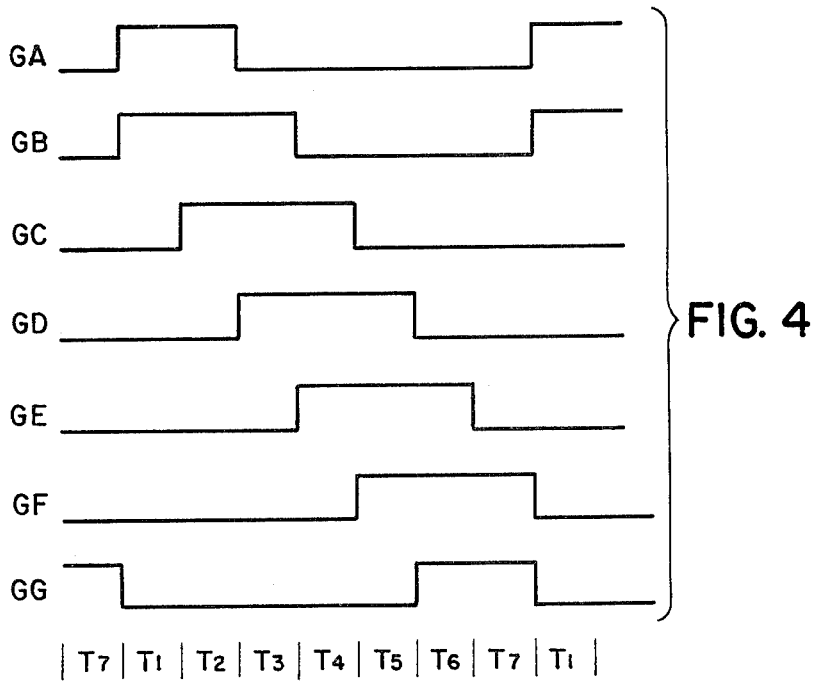
FIG. 4 is a time chart for describing operation of the display device shown in FIG. 3.

Referring to FIG. 4, it is preferred that the clock pulses (FIG. 3) make the grid driver 24 cyclically specify first through seventh time slots $T_1$, $T_2$, $T_3$, $T_4$, $T_5$, $T_6$, and $T_7$ in each time interval as depicted at the bottom. The time slots $T_1$–$T_7$ are for energizing the first through the seventh grids 11A–11G as the particular grids, respectively. With reference to the time slots $T_1$–$T_7$, the grid driver 24 cyclically produces first through seventh grid energizing pulses GA, GB, GC, GD, GE, GF, and GG. The first pulse GA has a first duration of two time slots, consisting of the first time slot $T_1$ and the next succeeding time slot $T_2$, and is for energizing the first grid 11A as the particular grid together with the nearest one of the intermediate grids, namely, the second grid 11B. The second pulse GB has a second duration of three time slots, consisting of the second time slot $T_2$ and the next preceding and succeeding ones $T_1$ and $T_3$, and is for energizing the second grid 11B as the particular grid together with two nearest ones of all grids, namely, the first and the third grids 11A and 11C. The first through the sixth pulses GC–GF are similar to the second pulse GB and the seventh pulse GG, to the first pulse GA. Timed by the clock pulses CL, the anode energizing circuit 25 selectively energizes the anode connections *21a–21g* of the first group 21 simultaneously with energization of each of the odd-numbered grids 11A, 11C, 11E, and 11G when all odd-numbered digits are to be visually simultaneously displayed. When it is desired to display, for example, the least significant digit alone, the anode connections *21a–21g* are selectively energized at the seventh time slot $T_7$ at each time interval. The other anode connections *22a–22g* are selectively energized in synchronism with energization of the even-numbered grids 11B, 11D, and 11F. As a result, a selected one of the numerals 0 through 9 is visually displayed by a specific one of the anode units 11A–11G in one of the time slots $T_1$–$T_7$ at which the grid driver 24 energizes one of the grids 11A–11G as the particular grid, to which the specific anode unit is in one-to-one correspondence.

Figure 5:
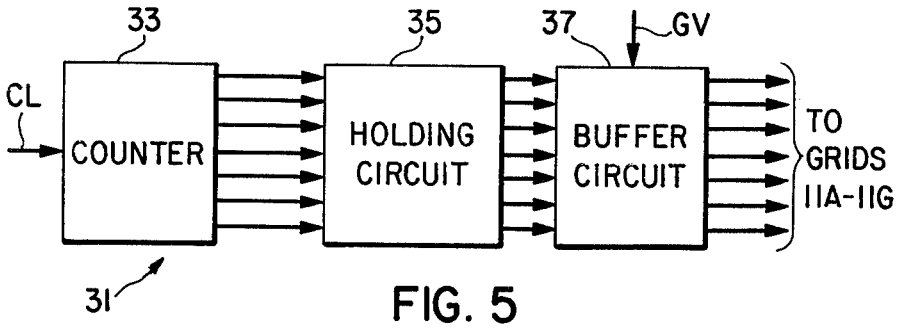
FIG. 5 is a block diagram of a grid driver used in a display device according to a more preferred embodiment of this invention.

Turning now to FIG. 5, a grid driver 31 is for use in a fluorescent display device according to a more preferred embodiment of this invention as the grid driver 24 illustrated with reference to FIGS. 3 and 4. The grid driver 31 cyclically energizes the grids 11A–11G (FIG. 3), three at each of the time slots $T_1$–$T_7$ (FIG. 4). When one of the two end grids 11A or 11G is energized as the particular grid together with the next one of the intermediate grids 11B or 11F, the grid driver 31 simultaneously energizes the other end grid 11G or 11A. In other words, the grid energizing pulses have a common duration of three time slots. It is general that the time slots $T_1$–$T_7$ of the successive time intervals are specified by the respective clock pulses CL. The grid driver 31 comprises a counter 33 having a plurality of output leads corresponding to the respective grids 11A–11G. The counter 33 counts the clock pulses CL to a predetermined count, such as seven in the example being illustrated, to cyclically supply first through seventh grid specifying pulses to the output leads in synchronism with the respective clock pulses. The grid driver 31 further comprises a holding circuit 35 that comprises, in turn, a plurality of holding elements (not shown) for the respective grid specifying pulses. Each holding element may be a one-shot multivibrator responsive to a relevant one of the grid specifying pulses for producing a grid selection pulse that raises up at the leading edge of the relevant grid specifying pulse and lasts three time slots. The holding elements therefore cooperate to cyclically produce grid selection pulse sets, each consisting of three grid selection pulses for selecting three of the grids 11A–11G at each time slot. Supplied with the grid selection pulse sets and the electrical voltage GV, a buffer circuit 37 cyclically produces grid energizing pulses. It is readily understood that the first grid energizing pulse for energizing the first grid 11A as the particular grid is produced in synchronisms with the clock pulses 2, 9, 16, 23, 30, . . . when the clock pulses are numbered from one from the instant at which the counter 33 is put into operation as by closure of a switch 39 (FIG. 3).

Figure 6:
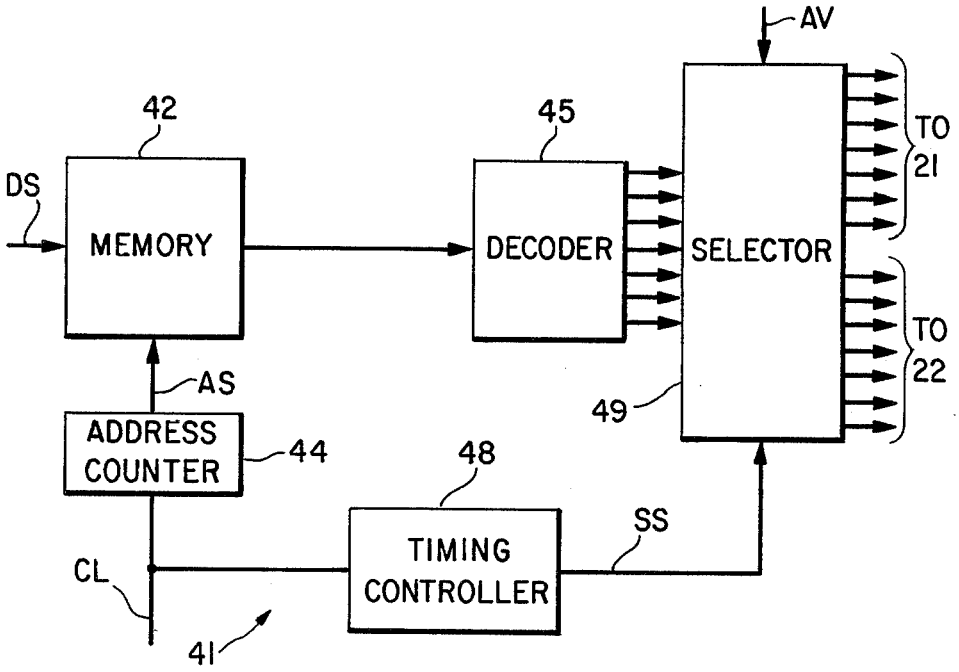
FIG. 6 is a block diagram of an anode driver for use in the display device according to the more preferred embodiment of this invention.

Referring to FIG. 6, an anode driver 41 is for use in combination with the grid driver 31 as the anode energizing circuit 25 (FIG. 3). The anode driver 41 selectively energizes one of the first and the second groups 21 and 22 of the anode connections at each of the time slots $T_1$–$T_7$ (FIG. 4). In the illustrated example, the first-group anode units or the odd-numbered anode units 12A, 12C, 12E, and 12G are energized at the first, third, fifth, and seventh time slots $T_1$, $T_3$, $T_5$, and $T_7$, respectively, and the second-group ones or the even-numbered ones 12B, 12D, and 12F, at the second, fourth, and sixth time slots $T_2$, $T_4$, and $T_6$, respectively. The anode driver 41 comprises a memory 42 having a plurality of memory addresses corresponding to the respective anode units 12A–12G. The memory 42 is usually successively supplied with display signals DS, each specifying one of the numerals 0 through 9, from a keyboard, an arithmetic unit, or the like. Each display signal DS is stored at a relevant one of the memory addresses. The anode driver 41 comprises an address counter 44 responsive to the clock pulses CL for producing an address signal AS that cyclically specifies the memory addresses for the anode units 12A–12G. The address counter 44 is put into operation simultaneously with the counter 33 of the grid driver 31 to make the address signal repeatedly specify, for example, the address for the first anode unit 12A at the instants of the clock pulses 2, 9, 16, 23, 30, . . . , namely, at the first time slots $T_1$ in the respective time intervals. The stored display signals are read out from the memory 41, one at each time slot, in accordance with the address signal AS. A decoder 45 has a plurality of output leads corresponding to the respective segmented anodes. Supplied with each read-out display signal, the decoder 45 selectively supplies the output leads with anode energizing pulses for the respective segmented anodes which are to be energized at the time slot at which the display signal is read out from the memory 42.

Further referring to FIG. 6, the anode driver 41 comprises a timing controller 48 responsive to the clock pulses CL for producing a group selection signal SS for selecting the one group at each of the time slots $T_1$–$T_7$. The timing controller 48 is put into operation in synchronism with the address counter 44 and cyclically counts the clock pulses CL to a preselected count, such as seven, to make the group selection signal SS alternatingly specify the first and the second groups 21 and 22 in each time interval. For example, the group selection signal SS cyclically specifies the first, second, and other anode units 11A, 11B, . . . in synchronism with the clock pulses 2, 3, . . . , 9, 10, . . . , 16, 17, . . . , 23, 24, . . . , 30, 31, and so on. An electrical power AV and the anode energizing pulses are supplied to a selector 49 connected to the anode connections of the first and the second groups 21 and 22. Responsive to the group selection signal SS, the selector 49 supplies successive sets of the anode energizing pulses alternatingly to the connections of the first and the second groups 21 and 22 in each time interval.

While this invention has so far been described in conjunction with a few preferred embodiments thereof, it is readily possible for those skilled in the art to put the invention into practice in various manners. For example, this invention is equally well applicable to a display device having only two or three anode units. The grids may be arcuately aligned. The hot cathode may be plural in number. The switch 39 (FIG. 3) is referred to merely as an example of means for synchronizing the anode driver 41 with the grid driver 31.

What is claimed is:

1. A fluorescent display device comprising two end grids, at least two intermediate grids between and in substantial alignment with said end grids, a plurality of anode units in one-to-one correspondence to all said grids, and a hot cathode over said anode units with all said grids interposed therebetween, each of said anode units being composed of a predetermined number of segmented fluorescent anodes arranged in a preselected configuration, wherein the improvement comprises a first group of anode connections for predetermined ones of said anode units with each of said connections connected to a prescribed one of the segmented anodes of each of said predetermined anode units and a second group of anode connections for the remaining anode units with each of said second-group anode connections connected to a preselected one of the segmented anodes of each of said remaining anode units, said predetermined anode units being every other one of all said anode units.

2. A fluorescent display device as claimed in claim 1, further comprising grid energizing means responsive to an electrical voltage supplied thereto for energizing, within a predetermined time interval composed of a plurality of time slots, all said grids, one at each time slot as a particular grid together with a nearest one of said intermediate grids and two nearest ones of all said grids when the particular grid is one of said two end grids and one of said intermediate grids, respectively, and an anode energizing circuit responsive to an electrical power supplied thereto for selectively energizing the anode connections of one of said first and said second grups without energizing the anode connections of the other of said groups, said one group being composed of the anode connections connected to the segmented anodes of one of all said anode units that is in one-to-one correspondence to the grid said grid energizing means is energizing as the particular grid.

3. A fluorescent display device as claimed in claim 2, further comprising a clock generator for generating a sequence of clock pulses defining time slots, wherein said grid energizing means comprises means responsive to said clock pulses for successively producing grid selection pulse sets, each consisting of three grid selection pulses, for cyclically selecting all said grids, three at each time slot, and means responsive to each of said grid selection pulse sets for supplying said electrical voltage to the three grids selected by said each grid selection pulse set for energization thereof, said three grids being the particular grid and two nearest ones of all said grids when the particular grid is one of said intermediate grids and one of said two end grids, the nearest one of said intermediate grids and the other of said end grids when the particular grid is each of said end grids.

4. A fluorescent display device as claimed in claim 3, wherein said grid selection pulse set producing means comprises means for counting said clock pulses to successively produce grid specifying pulses cyclically specifying all said grids, one at each time slot, and means for holding each of said grid specifying pulses during three time slots to produce each of said grid selection pulse sets.

5. A fluorescent display device as claimed in claims 3 or 4, wherein said anode energizing circuit comprises a timing controller responsive to said clock pulses for producing a group selection signal for alternately selecting said first and said second groups of anode connections at the respective time slots in each time interval as said one group, means for selectively producing anode energizing pulses for the respective segmented anodes in said one group, and means responsive to said electrical power, said group selection signal, said anode energizing pulses for selectively energizing the anode connections of said one group.

* * * * *